US006131770A

United States Patent [19]

Allen

[11] Patent Number: 6,131,770

[45] Date of Patent: Oct. 17, 2000

[54] HOT MELT DELIVERY SYSTEM

[75] Inventor: Martin A. Allen, Dawsonville, Ga.

[73] Assignee: Nordson Corporation, Westlake, Ohio

[21] Appl. No.: 09/173,341

[22] Filed: Oct. 15, 1998

[51] Int. Cl.[7] ..... B67D 5/14; B67D 5/62; B67D 5/40

[52] U.S. Cl. ..... 222/55; 222/146.2; 222/146.5; 222/318; 222/330; 222/331

[58] Field of Search ..... 222/146.2, 146.5, 222/59, 55, 189.06, 252, 255, 265, 278, 318, 330, 331; 239/379

[56] References Cited

U.S. PATENT DOCUMENTS

| | | | |
|---|---|---|---|
| 1,733,635 | 10/1929 | Stork | 222/318 X |
| 2,632,470 | 3/1953 | Livers et al. | 222/59 X |
| 2,669,256 | 2/1954 | Rampton | 222/59 X |
| 2,800,252 | 2/1957 | Wahl | 222/55 |
| 2,998,164 | 8/1961 | Clements | 222/255 X |
| 3,049,267 | 8/1962 | Edwards et al. | 222/255 X |
| 4,474,311 | 10/1984 | Petrecca | 222/146.5 |
| 4,642,040 | 2/1987 | Fox | 425/204 |
| 4,666,066 | 5/1987 | Boccagno et al. | 222/146.5 |
| 4,682,710 | 7/1987 | Turner, Jr. et al. | 222/146.2 |
| 4,898,527 | 2/1990 | Claasen | 222/54 |
| 5,061,170 | 10/1991 | Allen et al. | 425/197 |
| 5,680,963 | 10/1997 | Brusko et al. | 222/146.5 |
| 5,699,938 | 12/1997 | Siddiqui et al. | 222/146.5 |

FOREIGN PATENT DOCUMENTS 0286065 of 1987 European Pat. Off. ..... B29B 13/02

*Primary Examiner*—Kevin Shaver
*Assistant Examiner*—David Deal
*Attorney, Agent, or Firm*—Wood, Herron & Evans, L.L.P.

[57] ABSTRACT

A pump system for delivering a polymer melt adhesive to an applicator includes the components: a body having mounted thereon a hopper containing a molten polymer, a dual stream pump mounted on the body for receiving a melt from the hopper and discharging dual streams, a first flow course formed in the body interconnecting one pump stream with an outlet from the body, a flow meter for sensing the flow through the first course, and a second flow course interconnecting the other pump stream to a second outlet from the body. A pressure relief valve disposed in the first and second flow courses is activated in response to a predetermined pressure in each course due to downstream failure and diverts the flow therein from the body outlet to the hopper. Diversion of the flow to the hopper changes the flow rate through the flow meter which automatically activates controls to shutdown the system or activate an alarm. The body contains plugs for converting the apparatus from a dual pump stream system to a single pump system.

23 Claims, 4 Drawing Sheets

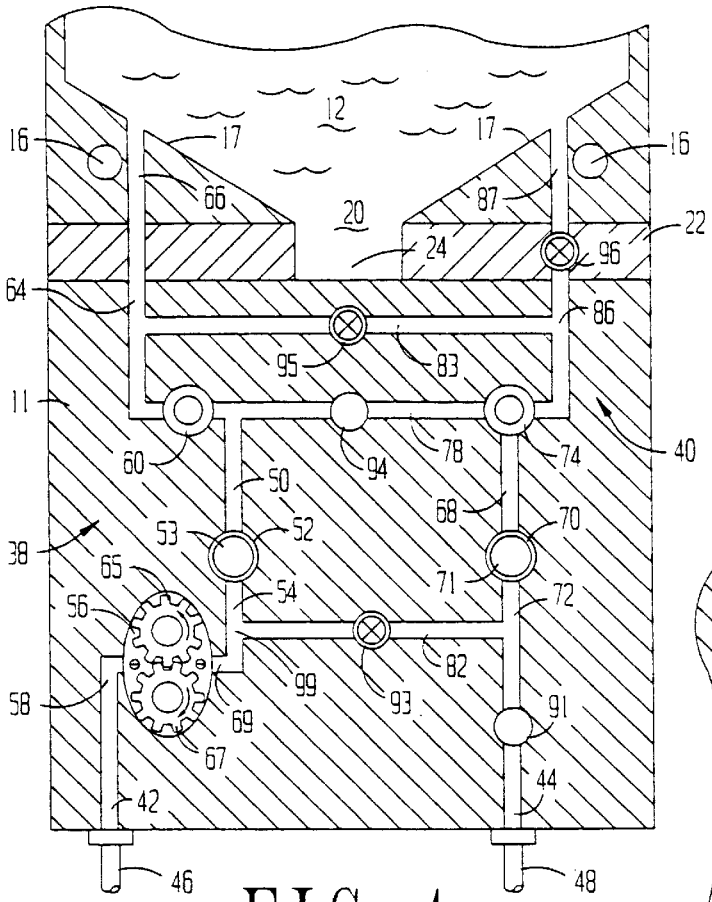
FIG 4
FIG 6
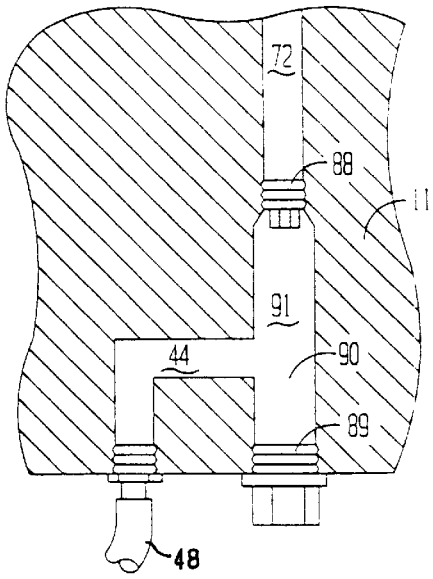
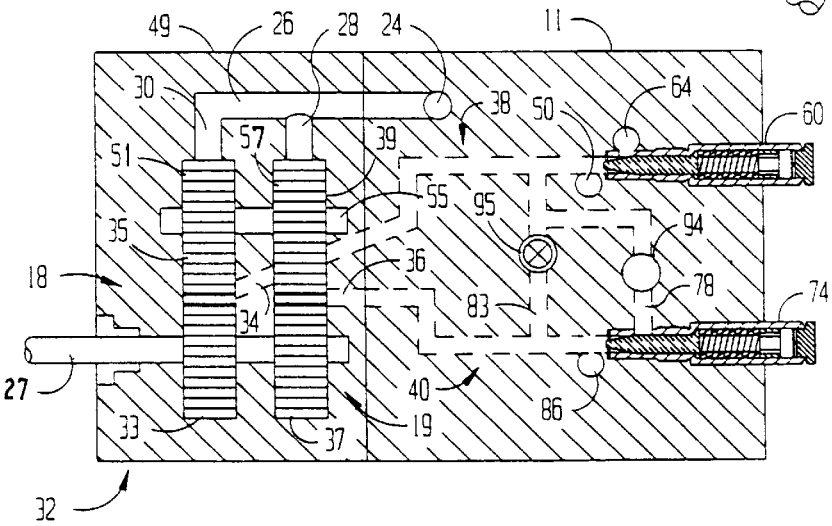
FIG 5

HOT MELT DELIVERY SYSTEM

BACKGROUND OF THE INVENTION

This invention relates generally to a system for melting and dispensing a thermoplastic hot melt adhesive.

Hot melt adhesives are used in many applications including laminating of film and nonwoven layers together, the gluing of diaper components, as well as a variety of other applications such as gluing furniture parts together, laminating, and the like. In order to meet the requirements for a diversity of applications, the applicator may be in the form of a hand-held glue gun or a battery of dispensing nozzles. The dispensing nozzles may be in the form of air-assisted meltblowing nozzles, spiral nozzles, bead nozzles, spray nozzles, or combinations of these.

The melting and dispensing apparatus receives the thermoplastic in solid form and melts it in a hopper from which positive displacement pumps deliver the hot melt to the dispensers via hoses and/or manifolds.

Most hot melt systems also include filters for removing foreign particles and char, and safety relief valves for preventing damage to the equipment in the event of down stream failure or plugging.

Hot melt delivery systems are disclosed in the following U.S. Patents: U.S. Pat. No. 4,474,311, U.S. Pat. No. 4,666,066, U.S. Pat. No. 5,061,170, U.S. Pat. No. 5,680,963, U.S. Pat. No. 5,699,938, and U.S. Pat. No. 5,692,884. The hot melt delivery and dispensing systems disclosed in the above U.S. Patents are representative only of a few types that are commercially available.

SUMMARY OF THE INVENTION

The pumping system of the present invention is designed to permit either dual or single pump operation, with the former being preferred. Both dual and single pump systems comprise a hopper for receiving and melting a hot melt adhesive, a positive displacement constant output pump such as a gear pump, two separate flow courses through the apparatus, a pressure relief valve in each course, and a flow meter for measuring the flow rate in at least one course. Each flow course also includes a filter positioned downstream of its respective pressure relief valve.

In normal operation, the hot melt flows from the hopper through each flow course in parallel streams to the applicators or dispensers. The terms applicator and dispenser are used interchangeably herein. In the dual pump mode, the pressure relief valve of the first course is designed to divert the flow therein from the dispenser fed by the first course to the hopper in response to a predetermined pressure above normal operating pressure as would occur if the dispenser fails or is plugged. The flow in the second course may continue, but in the preferred mode the second course will also shut down in response to a failure in the first course.

The pressure relief valve of the second course is designed to divert flow therein to the first flow course in response to a predetermined pressure above normal operating pressure. In one embodiment, both relief valves may be set at or near the same pressure so that activation of the second flow course valve may also activate the first flow course valve whereby all of the hot melt (in both courses) is diverted to the hopper. In the case of the pressure relief valve of the second flow course, the flow is initially to the first flow course (which may activate the first flow course valve) and then both courses to the hopper. The flow meter in the first course will therefore detect a large reduction in flow rate (because the flow never reaches the meter). The meter may include means to activate an alarm or shut down the operation of the entire delivery system.

In another embodiment, the relief valve in the first flow course will be set at a pressure higher than that in the second flow course. Activation of the relief valve in the second flow course again diverts the flow to the first flow course. The relief valve in the first flow course may not be activated (because it is set higher) whereby the combined first and second flow courses flow to the flow meter. The meter will thus detect a significant increase in flow rate signaling a system failure. Again, the meter may include means to shutdown the system or activate an alarm.

In normal operation, flow at equal rates passes from the dual pump (one pump for each course) through the first and second flow courses in parallel streams. A positive displacement flow meter is positioned in the first flow course (between the relief valve and the dispensers) and measures the flow rate therethrough. Because the flow rates through both courses are equal, the meter will sense one-half of the total melt flow rate through the delivery system. Activation of either pressure relief valve results in a change in a flow rate through the meter. As a result, the flow meter will sense either an increase or decrease in flow rate and the meter output (i.e. an electronic signal) can be used in combination with electronic controls to shutdown the system and/or activate an alarm. Thus a single flow meter can be used to monitor the status of both flow courses. The dual flow courses may feed dual dispensers or a single dispenser.

In the single pump mode of operation, one pump feeds hot melt to both courses simultaneously. The flow through the first course is identical to that in the dual pump mode (i.e. activation of the pressure relief valve diverts the flow therein from the dispenser to the hopper). However, the second flow course is configured (by inserting or removing plugs in the flow lines) so that activation of its pressure relief valve diverts the flow therein also to the hopper (as opposed to the first flow course in the dual pump mode). In normal operation, the flow rate through the first and second courses are equal, and the system is configured so that the two streams combine upstream of the flow meter. Thus in the single pump mode, the meter detects the total hot melt rate through the apparatus. Activation of either one of the relief valves will divert the flow in the respective flow course back to the hopper and, therefore, the meter will sense a significant decrease in the total flow rate. The change in meter output can be used to shutdown the system or activate an alarm. The single pump mode will generally comprise a single outlet for the dispenser or dispensers.

The flow passages which define the first and second courses are formed in a die body (the terms output block or manifold may also be used interchangeably in place of die body) and are designed to accommodate both the dual and single pump configurations. Thus, it is a simple matter to convert from one mode to another by removing plugs in certain passages, inserting plugs in others, and replacing one type of pump (single or dual) with another. The flow passages are machined with threaded holes for the insertion of threaded plugs at required points. The die body is machined so that either type of pump may be bolted onto the body.

Although the present invention is described in relation to the delivery of hot melt adhesives, it is to be understood that it can be used in applications involving the metering of other hot liquids in general, particularly heated thermoplastics.

BRIEF DESCRIPTION OF THE DRAWINGS

FIG. 4 is a sectional view taken along section 4—4 of FIG. 3.

FIG. 5 is a sectional view taken along section 5—5 of FIG. 3.

FIG. 6 is a sectional view of the preferred method of plugging a flow passage of the die body.

DESCRIPTION OF THE PREFERRED EMBODIMENTS

The general description of the hot melt delivery system of the present invention, in both dual and single pumping modes, will be described with reference to the schematic flow diagrams of FIGS. 1 (dual mode) and 2 (single mode), followed by a detailed description of the preferred and best mode construction.

Dual Pump Mode

Figure 1:
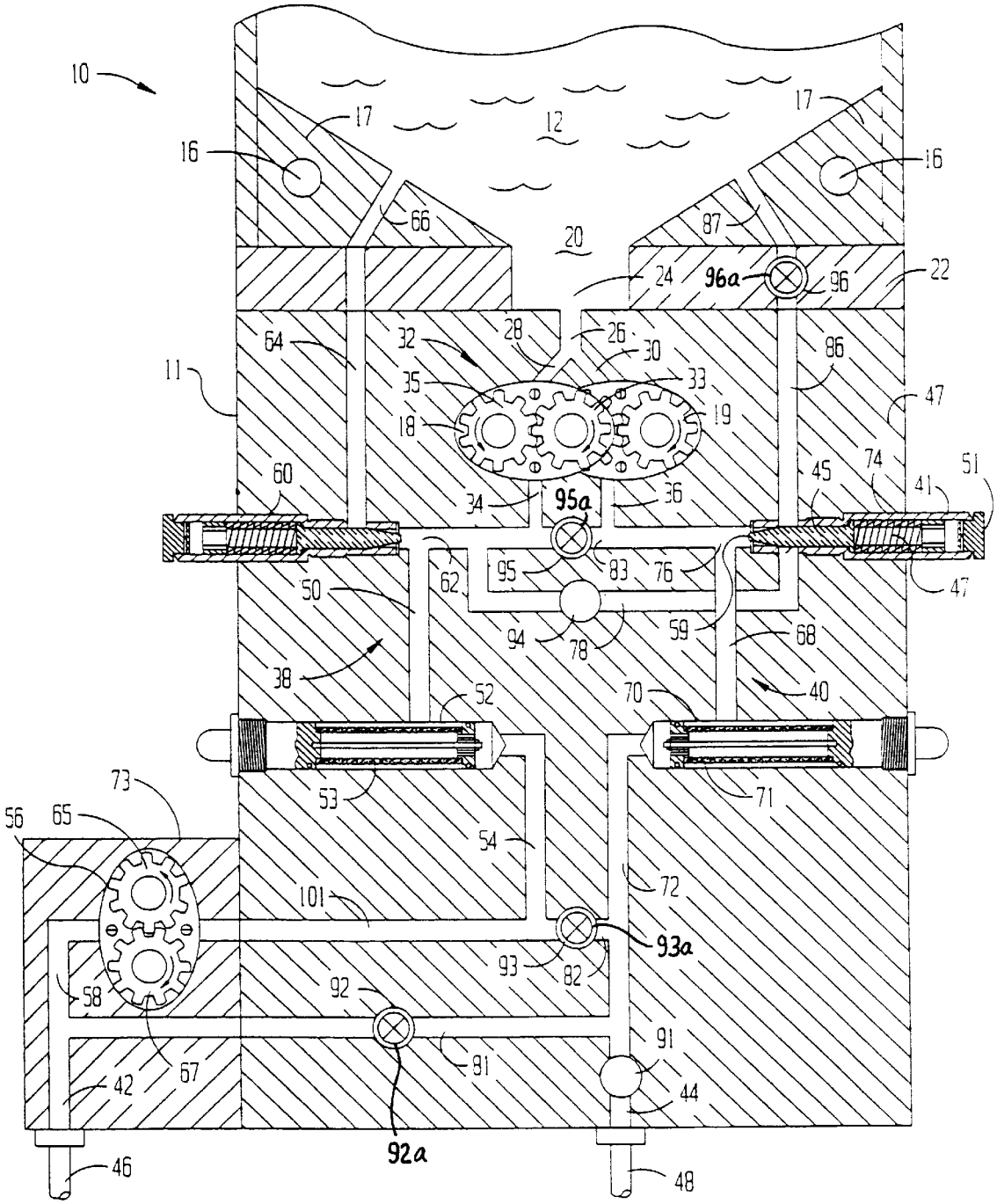
FIG. 1 is a schematic view illustrating the hot melt delivery system equipped with a dual stream pump.

As shown in FIGS. 1 and 4, hot melt delivery system 10 comprises a body 11 having a hopper 12 mounted thereon. The hopper 12 is adapted to receive thermoplastic resin or pellets and convert the pellets into a hot melt adhesive. The resin may also be liquefied in a pre-hopper (not shown) prior to being introduced into hopper 12 whereby heaters 16 serve to maintain the melt in the molten state. The hopper 12 may include converging wedges 17 as illustrated with heaters 16. The wedges 17 converge at sink 20 for feeding the portion of the system attached below hopper 12. The body 11 may include a cover plate 22 having elongate flow passage 24 formed therein for receiving the hot melt from hopper 12.

A pump suction passage 26 delivers a hot melt to a dual output positive displacement pump 32 (Dual Gear Pump). The passage 26 forks into two pump inlet passages, one 28 leading to one pump 18, and the other 30 leading to pump 19. As illustrated, the pumps 18, 19 have outlets 34 and 36 respectively. It is recognized that each pump 18, 19 will comprise a driven gear such as 33 and an idler gear 35 (see also FIG. 5). However, for convenience of illustration, only three gears are shown in their entirety in FIG. 1. In addition, in the actual embodiment, the pumps 18, 19 are in-line in the view of FIG. 1, and therefore, only pump 18 would be visible with the view of pump 19 being obscured thereby. However, the two pumps 18 and 19 have been shown schematically in side-by-side relation to illustrate the dual flow. The configuration of the dual gear pump 32 will be described later in more detail with reference to FIGS. 3 and 5.

Two hot melt flow courses 38 and 40 are shown interconnecting pumps 18 and 19 with apparatus outlets 42 and 44, respectively. The outlets 42, 44 may be connected to hoses 46 and 48 which are in turn connected to a single dispensing device or to separate dispensing devices (not shown) which will deposit the hot melt onto a substrate.

With reference to FIGS. 1 and 4, first flow course 38 comprises passage 50, filter cavity 52, passage 54, positive displacement flow meter 56, and meter discharge passage 58 which registers with outlet 42. Flow meter 56 will be described in detail in connection with the best mode description.

A pressure relief valve 60 is in fluid communication with the first flow course 38 as at 62. In response to a predetermined relief pressure, valve 60 opens and the flow from flow course 38 is diverted to the reservoir of hopper 12 through passage 64 in body 11 and passage 66 in hopper 12. The pressure relief valve 60 is a conventional spring-loaded valve and will be described in more detail in the description of the best mode.

The second flow course 40, interconnecting pump outlet 36 and apparatus outlet 44, comprises passage 68, filter cavity 70, and passage 72. A second pressure relief valve 74 is in fluid communication with the second flow course 40 as at 76. In response to a predetermined pressure, the second pressure relief valve 74 diverts the flow from the second course passage 68 to the first flow course 38 through passage 78.

In normal operation the flow through first course 38 will be from pump 18 though passage 50, through filter cavity 52 and filter cartridge 53, through passage 54, through positive displacement flow meter 56, through passage 58, and discharging at outlet 42 into hose 46. The flow through the second flow course 40 will be from pump 19, through passage 68, through filter cavity 70 and filter cartridge 71, through passage 72, discharging at outlet 44 into hose 48. An applicator (not shown) connected to nose 48 will deposit the hot melt onto a substrate. It is then seen that the hot melt flow is through flow courses 38 and 40 in parallel.

Because pumps 18 and 19 are positive displacement pumps which operate at exactly the same rpm, the flow through the first course 38 and second flow course 40 will be the same in the normal operation. Thus only a single flow meter 56 is required to measure the total throughput of the system 10. Meter 56 will sense only one-half the total flow through system 10.

To summarize the safety operation of the dual pump mode, two situations may be considered. First, if the first flow course 38 becomes plugged or otherwise fails causing the pressure to increase therein, pressure relief valve 60 will be activated (opened) and the flow through the first flow course 38 will be diverted from passage 50 to hopper 12 via passages 64 and 66. Second, if the second flow course 40 fails (plugged) valve 74 will be activated (opened) and the flow will be diverted from passage 68 to the first flow course 38 via passage 78, entering the first flow course 38 at 62.

In a first situation, the activation pressures of valves 60 and 74 are set at or near the same level. The diversion of flow from the second flow course 40 (due to excess pressure therein) to the first flow course 38 may then also activate valve 60 whereby most or all of the melt flow is diverted to hopper 12 as has been described. Meter 56 will therefore detect a significant reduction in flow rate. The output of flow meter 56 is an electrical signal calibrated with flow rate and may be used in combination with electronic control means (not shown) to shutdown the system 10 or activate a warning alarm in response to a predetermined reduction in flow rate.

In a second situation, the activation pressure of valve 60 may be set at a higher level than that of valve 74. Note that the higher activation pressure of valve 60 may be due simply to inaccuracies in the adjusting means of the valves 60, 74 (i.e. not necessarily set higher by intention). Diversion of flow from the second flow course 40 to the first flow course 38 may not result in valve 60 also being opened (because its activation pressure is higher) whereby all of the melt from both flow courses 38, 40 flows to meter 56 through the first flow course 38 as has been described. Meter 56 will thus sense a significant increase in flow rate signaling a failure. The meter output, in combination with electronic control means, may be set to shutdown the system 10 in response to a predetermined flow rate increase.

From the foregoing, it is seen that the system 10 may be shutdown in response to either a predetermined decrease or a predetermined increase depending upon the relative activation pressures of valves 60 and 74.

In the preferred mode, an increase or decrease of flow rate through meter 56 in the range of ±5% to ±20% will activate the electronic control means and result in a system shutdown and/or activation of an alarm signal. System shutdown in response to a deviation in flow rate in excess of ±5% is most preferred.

In order to lend versatility to the system 10 (e.g., switch from dual pump to single pump), several other flow passages 81, 82, and 83 are formed in body 11 interconnecting the first and second flow courses 38 and 40. Flow passage 81 interconnects flow courses 38 and 40 downstream of meter 56, and flow passages 82 and 83 interconnect the two flow courses 38, 40 downstream of the dual gear pump 32 and upstream of meter 56. Second flow course 40 also has flow passages 86 and 87 which divert the flow from the second flow course 40 to hopper 12 and are used in the single pump mode described below. The use of passages 81, 82, 83, 86, and 87 are described below with reference to the single pump mode of operation.

Figure 2:
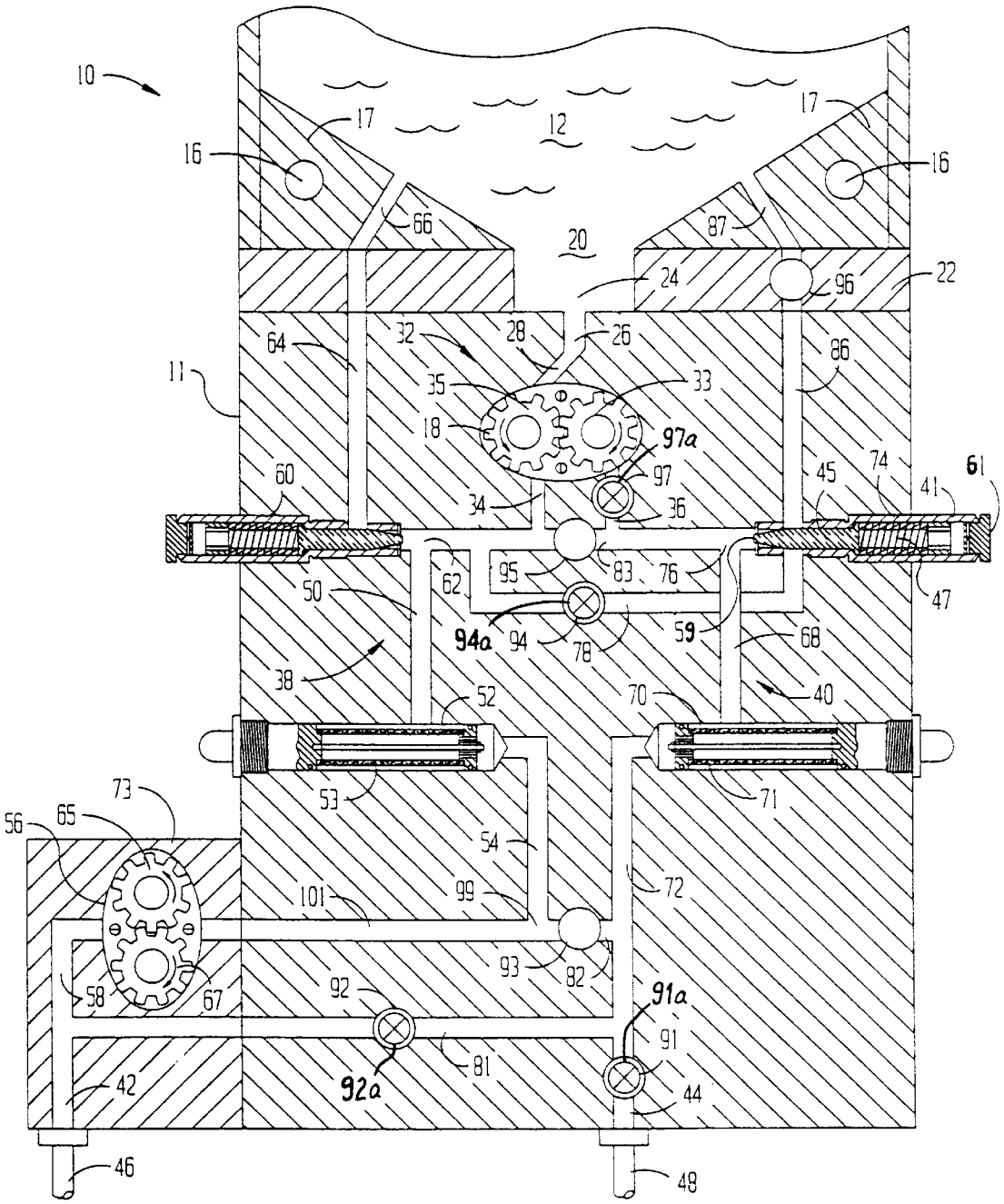
FIG. 2 is a schematic view illustrating the hot melt delivery system equipped with a single stream pump.

With reference to FIGS. 1 and 2, ports 91, 92, 93, 94, 95, 96, and 97 are used to divert the flow into the appropriate flow passages for the mode being employed. The ports 91-97 may be closed by inserting threaded plugs into the ports 91-97 as described in the best mode below. In the schematics of FIGS. 1 and 2, the ports without plugs are illustrated as plain circles and ports which have an inserted plug are indicated with a concentric circle with a cross-hatch. Thus in FIG. 1, ports 91 and 94 are open, and ports 92, 93, 95, and 96 have plugs 92*a*, 93*a*, 95*a*, 96*a* inserted respectively. The plugs 92*a*, 93*a*, 95*a*, 96*a* prevent any flow through the respective passages.

Single Pump Mode

The single pump mode is illustrated schematically in FIG. 2. A comparison of FIG. 1 and 2 shows the required insertion and removal of plugs to change from the dual mode to the single pump mode. Note that plug 97*a* in port 97 is used to close passage 36 in the single pump mode. In an alternate embodiment, the body of pump 18 may include means for closing passage 36 without the need of plug 97*a*.

Referring to FIG. 2, pump 19 has been removed and the dual gear pump 32 will be provided with only one pump inlet passage 28. Pump 18 is the single pump used to feed flow courses 38 and 40 as will be described. Hot melt entering body 11 through passage 26 flows through pump inlet 28 into pump 18 discharging at pump outlet 34. Port 95 has opened passage 83 to second flow course 40 so that a primary melt flow in passage 83 splits to feed both flow courses 38 and 40 simultaneously via 83.

The flow path for first flow course 38 is exactly the same as in the dual pump mode as described in detail above for FIG. 1. Activation of relief valve 60 again diverts flow to hopper 12 via passages 64 and 66. Second flow course 40 has been altered as follows. Passages 78 and apparatus outlet 44 are closed by inserting plugs 94*a*, 91*a* in ports 94 and 91, respectively. Passages 82, 83, and 86 have been opened by removing the plugs from 93*a*, 95*a*, 96*a* (shown in FIG. 1) ports 93, 95, and 96, respectively.

Whereas in the dual pump mode activation of relief valve 74 diverts the flow from passage 68 to passage 78, in the single pump mode activation of the valve 74 diverts the flow back to hopper 12 through passages 86 and 87. Thus for both flow courses 38, 40, a failure results in the diversion of the flow therethrough to hopper 12.

In the normal single pump mode of operation, the flow through the second flow course 40 is through passage 83, passage 68, filter cavity 70 and filter cartridge 71, through passage 72, and passage 82. The first and second flows from the first and second flow courses 38, 40 respectively combine at junction 99 to form a combined flow and flow therefrom to flow meter 56 via passage 101, through passage 58, and outlet 42. A dispenser (not shown) connected to outlet 42 will deposit the hot melt onto a substrate. There is no flow through outlet 44 in the single pump mode.

Because both flow courses combine prior to entering the flow meter 56, the meter 56 detects the total flow rate through the system 10. In the event either flow course 38, 40 fails whereby flow therethrough is diverted to hopper 12, the flow meter 56 will detect a significant decrease in flow rate which can be used as a signal to shutdown the system 10. A decrease in the range of 5% to 20% of the normal operating flow rate is preferred to activate the shutdown means with a decrease in excess of 5% most preferred.

Passage 81 is incorporated into body 11 for versatility in the event it is desired to by-pass meter 56 from the second flow course 40. The above description is, however, the preferred mode. The pressure relief valves 60 and 74 may be set at the same activation pressure or may set at different activation pressures so that one valve activates before the other.

Best Mode Construction

Details of the preferred embodiments of the construction of the dual gear pump 32, the positive displacement flow meter 56, the pressure relief valves 60 and 74, and the preferred means for plugging the flow ports will be described with reference to FIGS. 3 through 6.

For purposes of understanding the invention, the die body 11 and gear pump (dual gear or single gear) may be viewed as separate devices. In both dual pump 32 mode and single pump mode the same die body is used; however, the flow port configurations within the body 11 will be different as has been described. In the different modes, however, either a dual gear pump 32 or a single pump (not shown) will be attached to the body 11 using bolts (not shown). Only the dual gear pump 32 configuration is described below. Those skilled in the art will readily recognize that the dual gear pump 11 may be replaced with a single gear pump to change operating modes. Each type of pump will have a suction passage 26*a* that registers with passage 26*a* of system body 11. With the dual gear pump 32, the outlets 34, 36 will feed passages 34 and 36 respectively. With the single gear pump, only passage 34 will be active; passage 36 may be plugged as schematicaly illustrated in FIG. 2. The pump 32 may be sealed off using o-rings.

Figure 3:
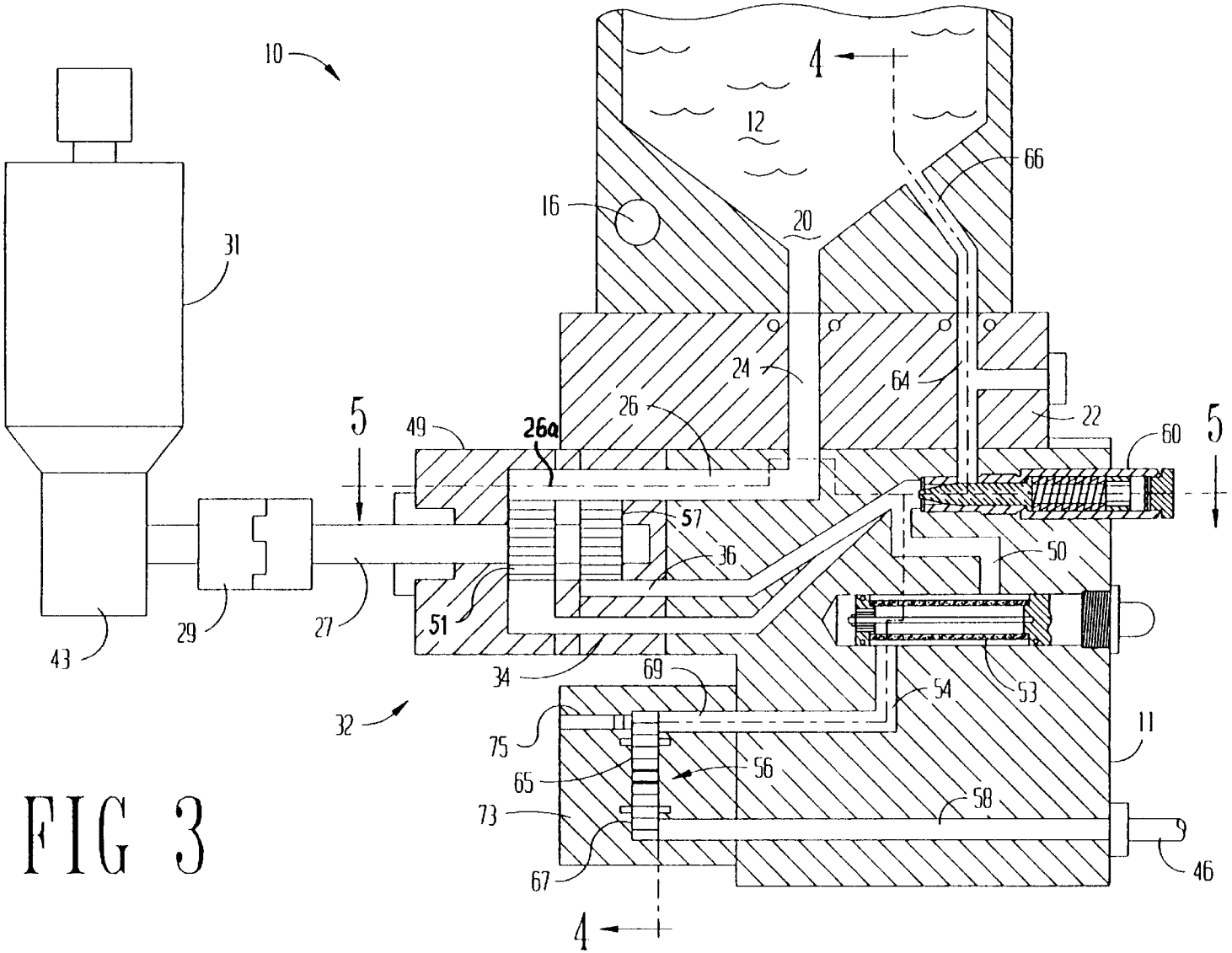
FIG. 3 is a side sectional view of a hot melt delivery system equipped with a dual stream pump.

As seen in FIGS. 3 and 5, dual gear pump 32 comprises housing 49 having internal cavities 51 and 57. Positive displacement pump 18 disposed within cavity 51 comprises driven gear 33 and idler gear 35. Pump 19 is disposed within cavity 57 and comprises driven gear 37 and idler gear 39.

Referring to FIG. 3, gears 33 and 37 are mounted on shaft 27, which is coupled to motor 31 via coupling 29 and speed reducer 43. It is preferred that motor 31 be variable speed and have an output between 1500 to 2000 rpm, and that the speed reducer 43 (gearbox) have a reduction ratio of 15:1. Because gears 33 and 37 are driven at the same speed by shaft 27, each pump 18, 19 will have substantially the same output flow rate. Idler gears 35 and 39 are mounted on shaft 55 which is internal to the dual gear pump 32. Bearing supports for shafts 27 and 55 and o-rings (not shown) are provided at required points. The single and dual gear pumps 32 are commercially available as exemplified in the Examples.

Pump 18 has outlet 34 which delivers hot melt to first flow course 38 as has been described. Pump 19 likewise has outlet 36 which feeds second flow course 40. As seen in FIG.

5, activation of pressure relief valve 74 will divert the hot melt flow from second flow course 40 to first flow course 38 via passage 78. The increased flow (and pressure) may activate relief valve 60 and the flow will be diverted to hopper 12 through passages 64 and 66 (see FIG. 3). Alternatively, valve 60 may not activate and the total melt flow will be through first flow course 38. In either case, meter 56 will detect a change (increase or decrease) in the normal operating flow rate and the shutdown means will be activated.

In the single pump mode, port 94 will be closed using a threaded plug and activation of valve 74 will divert the flow in the second flow course 40 directly to hopper 12 through passages 86 and 87 as has been described in relation to FIG. 2.

Flow meter 56 is a positive displacement flow meter and comprises housing 73 having therein two intermeshing freewheeling gears 65 and 67 (see FIGS. 3 and 4 ). A pressurized hot melt enters the meter at 69 causing the gears to rotate and discharges through passage 58. An electronic sensor 75 (see FIG. 3) detects the rotation rate of one of the gears 65, 67 and produces an electrical pulse train having a frequency proportional to the rotation rate. The sensor is pre-calibrated by the manufacturer whereby the rotation rate is directly related to the flow rate through the meter 56. The preferred flow meter 56 is one of the JML Series manufactured by AW Company of Frankesville, Wis. The electronic output of the meter 56 may be coupled with electronic controls (not shown) to continuously monitor the flow rate. If the flow rate falls below or increases above a predetermined level, the system 10 may be shutdown or an alarm activated. Electronic controls of this type are within the ordinary skill in the art.

In the dual pump mode, the throughput through both flow courses 38, 40 is equal during normal operation. Meter 56 will sense only the rate through first flow course 38 and the total throughput will be twice that detected by meter 56. In the single pump mode, meter 56 will sense the total hot melt flow rate since the flow in both courses 38, 40 combine at junction 99 prior to entering the meter 56. Thus in either mode only a single meter 56 is required to measure the total flow rate.

Pressure relief valves 60 and 74 are of the same design and, therefore, only the components of valve 74 will be described. As best seen in FIG. 1, relief valve 74 comprises jacket 41 which is threaded into body 11 for easy installation and removal. Valve 74 further comprises moveable plunger 45, compression spring 47 and back-up plug 61 which is threaded into the end of the jacket 41. Spring 47 is in compression and imparts a forward force (to the left in FIG. 1) which acts to seat the end of plunger 45 at valve inlet port 59 whereby the valve 74 is closed. A pressurized melt in passage 76 exerts a rearward force on plunger 45. In normal operation, the pressure is such that it cannot overcome the forward force of spring 47 and the valve 74 remains closed whereby the melt will flow from passage 76 into passage 68 and through course 40 as has been described. The above description of valves 60 and 74 is by way of illustration only as pressure relief valves of other design may also be used. Note that the pressure relief valves 60 and 74 are threadingly connected to body 11 making them readily accessible for replacement or adjustment.

If the pressure in passage 76 increases in response to a downstream failure, the excess pressure will force plunger 45 rearward and open flow passages 78 and 86. In the dual pump mode, passage 86 will be plugged at port 96 and therefore the melt will flow through passage 78 into flow course 38. The excess pressure at 76 will be transmitted through passage 78 to passage 62 whereby valve 60 may or may not be opened as has been described.

In the single pump mode, port 96 will be opened (unplugged) and a plug 94*a* will be inserted into port 94 closing passage 78. Opening of valve 74 will then divert the flow in flow course 40 directly to hopper 12 via passages 86 and 87. The force required to open the valve 74 is adjusted by positioning (by threading in or out) back-up plug 51 whereby the compressive force in spring 47 is increased or decreased. In the preferred mode, both valves 60 and 74 are adjusted to have nearly the same activation pressure.

Filter cartridges 53 and 71 may be of the same design and may be any type designed to filter out particles and impurities larger than a predetermined size (e.g., 150 to 200 microns). A wire mesh, pleated filter is one of many designs that may be used. The cartridges 53,71 may be inserted in the respective filter cavities 52,70 and attached to body 11 by threaded connections. Each filter cartridges 53, 71 can be easily removed for replacement or cleaning.

The preferred method for plugging the various flow ports is illustrated in FIG. 6 with reference to flow port 91. The configuration consists of threaded plugs 88 and 89. Plug 89 is inserted in a threaded hole 89*a* in body 11 and is in present in both the dual and single pump modes. Plug 88 is threaded in body 11 in recessed cavity 90. In the dual pump mode, plug 88 is removed by removing plug 89 and then unthreading plug 88 whereby it can be withdrawn through the hole 89*a* vacated by plug 89. Then plug 89 is reinstalled. With plug 88 removed, port 91 is open and melt will flow from outlet 72 through the port and into passage 44 and hose 48. In the single pump mode, the procedure is reversed and plug 88 is threadingly inserted whereby port 91 is closed and passage 72 is plugged prohibiting flow therethrough. Plug 88 is preferably a ⅛ inch NPT plug and plug 89 is preferably a ¼ inch NPT plug so that the diameters of the hole 89*a* for plug 89 and recess 90 are approximately twice as large as plug 88 whereby it can easily be inserted or withdrawn from port 91. Each port 91–97 is provided with similar means for opening or closing the port.

The system 10 may include heaters (not shown) positioned to maintain the hot melt at the desired temperature.

Assembly and Operation

The hot melt delivery system 10 will initially be configured to operate in either dual pump or single pump mode with the former being preferred. The pump 32 will be attached to body 11 using bolts (not shown) and flow ports 91–97 will be configured for either mode. In the dual pump mode, hot melt dispensers (not shown) will be attached to outlet hoses 46 and 48. Different dispensers may be used on each outlet. In single pump mode, generally only a single dispenser will be attached to hose 46 with outlet 44 being closed. The dispenser may be in the form of a hand-held glue gun or a battery of dispensing nozzles. The dispensing nozzles may be in the form of air-assisted meltblowing nozzles, spiral nozzles, bead nozzles, spray nozzles, or combinations of these.

The following summarizes the configuration of ports 91 through 97 for both modes of operation where open indicates no plug and closed indicates a plug is inserted in the port:

| Port | Passage | Port Configuration: Dual Pump Mode | Port Configuration: Single Pump Mode |
|---|---|---|---|
| 91 | 44 | OPEN | CLOSED |
| 92 | 81 | CLOSED | CLOSED |
| 93 | 82 | CLOSED | OPEN |
| 94 | 78 | OPEN | CLOSED |
| 95 | 83 | CLOSED | OPEN |
| 96 | 86 | CLOSED | OPEN |
| 97 | 36 | OPEN | CLOSED |

Heaters 16 are activated whereby hopper 12 contains a molten polymer. Most hot melt adhesives are applied at temperatures ranging from about 270° F. and 340° F. which is well within the normal operating temperature of the present delivery system. Additional heating elements may be incorporated into the body of the present invention as needed.

Any of the hot melt adhesives may be used in the present invention. These include EVA's (e.g. 20–40 wt % VA). These polymers generally have lower viscosity than those used in meltblowing webs. Conventional hot melt adhesives useable include those disclosed in U.S. Pat. Nos. 4,497,941, 4,325,853, and 4,315,842, the disclosures of which are incorporated herein by reference. The preferred hot melt adhesives include SIS and SBS block copolymer based adhesives. These adhesives contain block copolymer, tackifier, and oil in various ratios. The above melt adhesives are by way of illustration only; other hot melt adhesives may also be used.

Pump 32 will be started which will start the flow of hot melt from hopper 12 through flow courses 38 and 40 in parallel as has been described. The flow rate through the system will be measured by flow meter 56 and the speed of motor 31 will be adjusted until the desired flow rate is achieved. The flow rate will depend on the polymer being processed, the type of applicators (dispensers), and the application.

As has been described in detail, a failure in flow courses 38 and 40 will cause valves 60 and 74 to be activated. The following gives ranges of normal operating pressure and valve activation pressure. In the preferred mode, flow courses 38 and 40 will have the same operating pressure and valves 60 and 74 will be adjusted to have the same activation pressure.

| | Broad Range | Preferred Range |
|---|---|---|
| Normal Operating Pressure (psi) | 20–10,000 | 100–1,000 |
| Pressure Relief Valve Activation Pressure (psi) | 20–8,000 | 100–1,000 |

Electronic sensor 75 of meter 56 will be connected to electronic controls (not shown) to shutdown the system 10 (pumps) or activate an alarm in response to activation of either of valves 60 or 74 and the associated reduction in flow through the meter 56 as has been described.

EXAMPLES

A dual pump delivery system 10 as generally illustrated in FIGS. 3–6 was constructed. Flow passages were provided to accommodate both a dual pump or a single pump. The initial structure was for the dual pump mode, and had the following components Dual Pump
- Brand: Zenith
- Model: HPB
- Rpm: 100
- Flow Rate Per Pump: 1.168 cc/rev/stream Filter
- Type: 150 micron Pressure Relief Valves
- Type: B12900-S
- Size: HI-PRESS
- Setting (psi): 800 psi Flow Meter
- Brand: JML
- Model: DX-902

The system 10 pumped a hot melt adhesive at a temperature of about 290° F. feeding two separate dispensers (hot melt applicators).

The system 10 was changed to a single pump mode by replacing the dual pump 32 with a single pump with the following properties Single Pump
- Brand: Zenith
- Rpm: 100
- Flow Rate: 1.168 cc/rev/stream The passage arrangement was modified as shown schematically in FIG. 2. The conversion from the dual pump to the single pump mode required approximately 30 minutes. The operation was resumed at a hot melt temperature of about 300° F. A single dispenser was used to apply the hot melt discharged from the delivery system.

SUMMARY

Although the system of the present invention has been described in detail with respect to hot melt adhesives, it is to be emphasized that it can be used with any system handling heated fluids, particularly heated thermoplastics. The typical temperatures of hot melt adhesive application is between about 250° F. and 350° F.

What is claimed:

1. A dual pump delivery system for delivering a hot liquid to an applicator, the delivery system comprising:

(a) a body including a first outlet and a second outlet;

(b) a hopper operatively mounted on said body for containing the hot liquid;

(c) a dual output positive displacement pump operatively mounted to the body for receiving the hot liquid from the hopper and discharging first and second flows of hot liquid;

(d) a first flow course formed in the body for conducting the first flow from the dual output positive displacement pump to the first outlet of the body;

(e) a first pressure relief valve operatively mounted to the body and in fluid communication with the first flow course, said first pressure relief valve activated in response to a predetermined pressure of the first flow in the first flow course to divert the first flow from the first flow course to the hopper;

(f) a positive displacement flow meter operatively mounted to the body, the flow meter operable to measure a flow rate through the first flow course downstream of the first pressure releif valve;

(g) a second flow course formed in the body for conducting the second stream from the dual pump to the second outlet of the body; and (h) a second pressure relief valve operatively mounted to the body and in fluid communication with the second flow course, the second pressure relief valve activated in response to a predetermined pressure of the second flow in the second flow course to divert the second flow from the second flow course to the first flow course up stream of the positive displacement flow meter.

2. The delivery system of claim 1, further comprising:

a first filter operatively mounted in the first flow course downstream of the first pressure relief valve; and a second filter operatively mounted in the second flow course downstream of the second pressure relief valve.

3. The delivery system of claim 1, wherein said predetermined pressures for respectively activating the first and second pressure relief valves are the same.

4. The delivery system of claim 1, wherein the dual output positive displacement pump is a dual gear pump sized to discharge the first and second flows at a substantially constant operating pressure of between 100 and 1,000 psi.

5. The delivery system of claim 4, wherein the first and second pressure relief valves are set to activate respectively at a pressure of 100 to 300 psi above the constant operating pressure of the first and second flows.

6. The delivery system of claim 1, wherein the positive displacement flow meter comprises intermeshing gears and a sensor for detecting a rotation rate of one of the intermeshing gears.

7. The delivery system of claim 6, further comprising controls operably configured to activate an alarm in response to a predetermined change in the rotation rate detected by the flow meter, the rotation rate corresponding to a flow rate through the flow meter.

8. The delivery system of claim 7, wherein the predetermined change in the rotation rate corresponds to an increase in the flow rate detected by the flow meter due to activation of the second pressure relief valve.

9. The delivery system of claim 1, wherein the dual output positive displacement pump comprises:

a first set of intermeshing gears operable for discharging the first flow in the first flow course; and a second set of intermeshing gears operable for discharging the second flow in the second flow course.

10. The delivery system of claim 9, wherein the first set of intermeshing gears are identical to the second set of intermeshing gears, and wherein the first and second sets of intermeshing gears are rotated at an identical rotation rate for discharging the first and second flows respectively at an identical flow rate.

11. The delivery system of claim 7, wherein the predetermined change in the rotation rate corresponds to a change in the flow rate detected by the flow meter of greater than 5%.

12. The delivery system of claim 1, further comprising:

controls operably configured to shutdown the dual output positive displacement pump in response to a predetermined change in the flow rate in the first flow course detected by the flow meter.

13. The delivery system of claim 1, wherein the liquid is a hot melt adhesive, and the hopper includes heaters for heating the hot melt adhesive to a temperature between 250° F. and 350° F.

14. A single pump delivery system for delivering a hot liquid to an applicator, the delivery system comprising:

(a) a body having an outlet for discharging a combined flow of the hot liquid to an applicator;

(b) a hopper operatively mounted on the body for containing the hot liquid;

(c) a positive displacement pump operatively mounted to the body for receiving the hot liquid from the hopper and discharging a first flow and a second flow of the hot liquid;

(d) a first flow course formed in the body for conducting the first flow of the hot liquid from the pump to the outlet;

(e) a first pressure relief valve in fluid communication with the first flow course, said first pressure relief valve being activated in response to a predetermined pressure of the first flow in the first flow course to divert the first flow from the first flow course to the hopper;

(f) a first filter operatively mounted in the first flow course downstream of the first pressure relief valve;

(g) a positive displacement flow meter operatively mounted in the first flow course, the flow meter operable to detect a flow rate in the first flow course downstream of the filter;

(h) a second flow course formed in the body operable to receive the second flow of a hot liquid from the pump and to combine the second flow with the first flow to form the combined flow in the first flow course at a junction intermediate the first filter and the flow meter whereby the flow meter measures a total flow rate of the combined flow from both the first and second flow courses;

(i) a second pressure relief valve in fluid communication with the second flow course, said pressure relief valve being activated in response to a predetermined pressure of the second flow course in the second flow course to divert the second flow from the second flow course to the hopper;

(j) a second filter in the second flow course intermediate the second pressure relief valve and the junction with the first flow course; and (k) controls operatively connected to the flow meter, the controls responsive to a predetermined reduction in the detected flow to perform one of activating an alarm and shutting down the pump.

15. The delivery system of claim 1, wherein said body further includes a plurality of selectable passages operable to selectively convert the second flow course in the body to a single pump mode wherein the second flow course is operable to receive the second flow and to combine the second flow with the first flow in the first flow course at a junction intermediate the first pressure releif valve and the flow meter, and wherein the second pressure relief valve diverts the second flow to the hopper in response to the predetermined pressure.

16. The delivery system of claim 14, further comprising:

controls operably configured to shutdown the delivery system in response to a predetermined change in the flow rate detected by the flow meter.

17. The delivery system of claim 16, wherein said predetermined change is in the range of between 5% to 20% below a normal operating flow rate.

18. A pump system for depositing a polymer melt adhesive on a substrate, the system comprising:

(a) a body including a first outlet and a second outlet;

(b) a hopper operatively mounted on the body and including heaters for melting the adhesive in the hopper;

(c) a dual output positive displacement pump operatively mounted to the body for receiving adhesive from the hopper and discharging a first flow and a second flow of adhesive;

(d) a first flow course formed in the body and interconnecting the first flow from the pump to the first outlet of the body;

(e) a first pressure relief valve operatively mounted to the body and in fluid communication with the first flow course, said first pressure relief valve being activated in response to a predetermined pressure in the first flow course to divert the flow from the first first flow course to the hopper;

(f) a positive displacement flow meter operatively mounted to the body for receiving and measuring the rate of flow through the first flow course;

(g) a second flow course formed in the body and interconnecting the second flow from the pump to the second outlet of the body;

(h) a second pressure relief valve operatively mounted to the body and in fluid communication with the second flow course, said second pressure releif valve activated in response to a predetermined pressure to divert the second flow from the second flow course to the first flow course;

(i) a first applicator coupled to the first outlet and a second applicator coupled to the second outlet for depositing the adhesive onto a substrate; and (j) controls connected to said flow meter and responsive to a predetermined change in the rate of flow for one of activating an alarm and shutting down the pump.

19. The system of claim 18, wherein said first and second applicators are each a selected one of a hand-held glue gun, meltblowing nozzle, spiral nozzle, bead nozzle, and spray nozzle.

20. The pump system of claim 19, wherein said first applicator is different from said second applicator.

21. The delivery system of claim 15, further comprising:

a first filter operatively mounted in the first flow course intermediate to the first pressure releif valve and the junction with the second flow course; and a second filter operatively mounted in the second flow course downstream of the second pressure relief valve whereby the second flow passes through the second filter when the second pressure relief valve is unactivated.

22. The delivery system of claim 15, wherein the body includes a detachable housing encompssing the dual output positive displacement pump.

23. The delivery system of claim 22, wherein the dual output positive displacement pump comprises a selectable flow passage and a single stream pump having a single pump outlet providing a primary flow, the selectable flow passage coupled to the single pump outlet to provide portions of the primary flow as the first and second flows respectively to the first and second flow courses.

* * * * *

UNITED STATES PATENT AND TRADEMARK OFFICE

CERTIFICATE OF CORRECTION

PATENT NO. : 6,131,770
DATED : October 17, 2000
INVENTOR(S) : Martin A. Allen

It is certified that error appears in the above-identified patent and that said Letters Patent is hereby corrected as shown below:

Column 3,
Line 38, after “have” insert -- pump --.

Column 4,
Line 9, delete “course”.
Line 9, after “38” insert -- as at 62 --.
Line 11, after “operation” insert -- , --.
Line 19, change “nose” to -- hose --.
Line 36, change “(plugged)” to -- (plugged), --.

Column 5,
Line 48, delete “via 83”.
Line 56, before “ports” insert -- from --.

Column 6,
Lines 30 and 31, after “pump” insert -- 32 --.
Line 32, after “body” insert -- 1 --.
Line 37, change “dual gear pump 32” to -- dual pump --.
Line 41, change “26” to -- 26a --.

Column 7,
Line 20, change “to” to -- 65, 67 to --.
Line 21, change “65, 67” to -- 65 --.

Column 8,
Lines 31 and 50, after “pump” insert -- 32 --.

Column 9,
Line 17, change “heating” to -- heaters --.

Column 10,
Line 20, after “pump” insert -- 32 --.

Column 12,
Line 40, after “flow” insert -- rate --.
Line 59, delete “pump”.

UNITED STATES PATENT AND TRADEMARK OFFICE

CERTIFICATE OF CORRECTION

PATENT NO. : 6,131,770
DATED : October 17, 2000
INVENTOR(S) : Martin A. Allen

It is certified that error appears in the above-identified patent and that said Letters Patent is hereby corrected as shown below:

Column 13,
Line 8, delete the duplicate occurrence of “first” before “flow”.

Column 14,
Line 1, delete “pump”.

Signed and Sealed this

Twentieth Day of May, 2003

JAMES E. ROGAN
*Director of the United States Patent and Trademark Office*